United States Patent [19]

Rutenberg et al.

[11] 4,021,149

[45] May 3, 1977

[54] FLUID DRIVEN RECIPROCATING PUMP

[75] Inventors: Alexander Rutenberg, Haifa; Alexander Zur, Kfar Bialik, both of Israel

[73] Assignee: TMB Industrial Maintenance Ltd., Kiryat Bialik, Israel

[22] Filed: Dec. 15, 1975

[21] Appl. No.: 640,857

[52] U.S. Cl. ..... 417/395
[51] Int. Cl.[2] ..... F04B 43/26
[58] Field of Search ..... 417/280, 393, 394, 395, 417/401, 403

[56] References Cited

UNITED STATES PATENTS

| | | | |
|---|---|---|---|
| 2,702,006 | 2/1955 | Bachert | 417/393 |
| 3,056,353 | 10/1962 | Peters | 417/393 |
| 3,260,212 | 7/1966 | Johnson | 417/399 |
| 3,781,141 | 12/1973 | Schall | 417/401 |
| 3,791,768 | 2/1974 | Wanner | 417/393 |

FOREIGN PATENTS OR APPLICATIONS

| | | | |
|---|---|---|---|
| 897,311 | 5/1962 | United Kingdom | 417/280 |
| 1,387,880 | 3/1975 | United Kingdom | 417/401 |

*Primary Examiner*—William L. Freeh
*Attorney, Agent, or Firm*—Benjamin J. Barish

[57] ABSTRACT

A fluid driven reciprocating pump is described, particularly for use in feeding fertilizer solution to an irrigating water line, the pump being driven solely by the pressurized water in the supply line and requiring no electricity or other power source for either driving or controlling the pump. The described pump includes a pair of flexible diaphragms defining a pair of expansible chambers, and a reciprocating rod connecting the diaphragms to each other so that they move in unison. A main valve supplies pressurized water to the expansible chambers, and a pilot valve controlled by operator elements carried by the reciprocating rod controls the main valve connections to the pair of expansible chambers such as to effect an expansion and contraction of the chambers.

9 Claims, 6 Drawing Figures

FLUID DRIVEN RECIPROCATING PUMP

BACKGROUND OF THE INVENTION

The present invention relates to a fluid-driven reciprocating pump.

A need exists for a pump to be used in the field to feed fertilizer solution from an open tank into a pressurized water line, which water line feeds the water and fertilizer to the irrigation system, such as a sprinkler or dripper system. The commercially available pumps are not entirely satisfactory for this purpose, since most or all of those known to us require an internal combustion driving motor, or a source of electricity for drive or control purposes; many other pumps are easily clogged by solid particles in the fertilizer solution.

An object of the present invention is to provide a pump in which the driving power for the pump is obtained from the pressurized water in the water line feeding the irrigation system, the pump, therefore, not requiring a source of electricity either for drive or control purposes. Another object is to provide a pump which is not easily clogged by solid particles in the liquid being pumped.

SUMMARY OF THE INVENTION

The fluid-driven reciprocating pump of the present invention comprises a housing defining a pair of expansible chambers each containing a displaceable member movable to expand and contract the respective chamber. The movable member in at least one of the expansible chambers is a flexible diaphragm to which the material to be pumped is conducted so as to be pumped upon the expansion and contraction of the chambers. A reciprocating rod connects the flexible diaphragm of the one chamber with the displaceable member of the other chamber so that they move in unison. The pump further includes a main valve having a driving fluid inlet, a driving fluid outlet, a connection to the pair of expansible chambers, and a piston movable from a first position effecting communication between the fluid inlet and the pair of chambers to introduce the driving fluid into the chambers, to a second position effecting communication between the chambers and the fluid outlet to discharge the fluid from the chambers. A pilot valve having a movable piston and fluid connections to the main valve is provided for controlling the position of the piston of the main valve. The pump further includes operating means carried by the reciprocating rod engagable with the piston of the pilot valve for controlling the connections between the pilot valve and main valve, and thereby the fluid connections from the main valve to the pair of expansible chambers, to effect an expansion and contraction of the diaphragm chambers.

Since two expansible chambers are provided both driven by the drive fluid, pump outlet pressures can be obtained which are higher than the pressure of the driving fluid. The flexible diaphragm chamber is used for pumping the material, such as a fertilizer solution, whereas the second expansible chamber is used for augmenting the driving force. The displaceable member in the latter expansible chamber (i.e. the non-pumping chamber) could conceivably be a piston displaceable in a cylinder, but is preferably also a flexible diaphragm.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF THE PREFERRED EMBODIMENT

Figure 1:
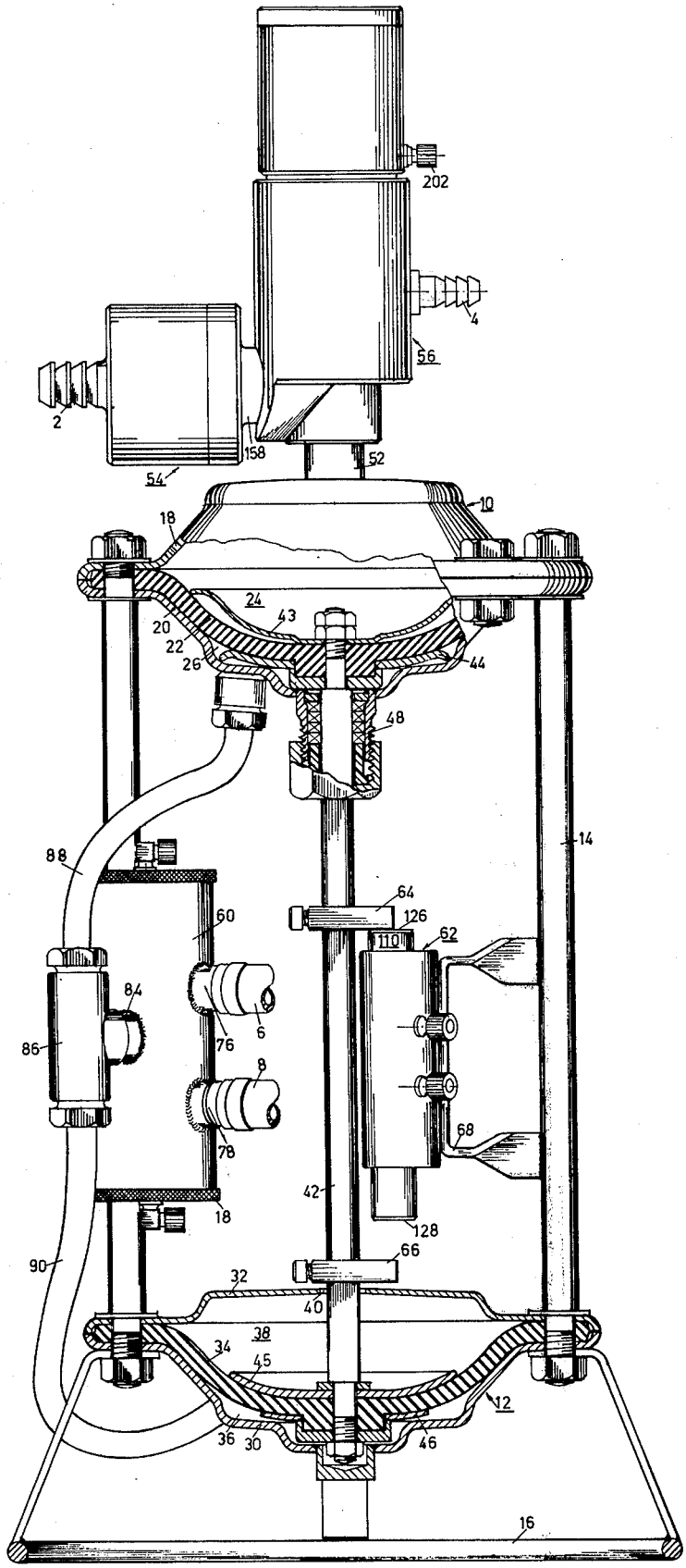
FIG. 1 is an elevational view, partly in section, of a fluid-driven reciprocating pump constructed in accordance with the invention.

The fluid-driven reciprocating pump illustrated in FIG. 1 of the drawings is particularly useful for pumping a fertilizer solution into the irrigating water feed line. The fertilizer solution is introduced through inlet 2 and pumped out through outlet 4. The drive for the pump is the pressurized water of the irrigating water line, which water is applied through inlet pipe 6 to the pump and exits through outlet pipe 8. Outlet 4 for the fertilizer solution is to be connected to the irrigation pipe downstream of the pump, so that the fertilizer solution is mixed with the irrigating water at the same time it is used for irrigating the crops.

The reciprocating pump illustrated in the drawings comprises a housing including an upper housing section 10 and a lower housing section 12 rigidly coupled together by a circular array of tie rods 14 and supported on a base 16. The upper housing section 10 is formed of a pair of dished plates 18, 20 bolted together with a flexible diaphragm 22 interposed between the two, thereby defining a first expansible chamber 24 between the diaphragm and upper plate 18, and a second expansible chamber 26 between the diaphragm and the lower plate 20. Similarly, the lower housing section 12 is formed of a pair of dished plates 30, 32 bolted together with a flexible diaphragm 34 fixed between the two plates, thereby defining an expansible chamber 36 between the diaphragm and the lower plate 30. The space 38 between the diaphragm and the upper plate 32 is vented to the atmosphere at 40.

The two diaphragms 22, 34 are coupled together by means of a rod 42 which passes through plates 20 and 32, the rod being clamped to the center of diaphragms 22, 34 by reinforcing plates 43, 44, 45, and 46. The passage of rod 42 through plate 20 is sealed by packing 48.

The water entering the pump through pipe 6 and exiting through pipe 8 causes the expansion and contraction of chambers 26, 36 by flexing diaphragms 22, 34 upwardly and downwardly; this in turn reciprocates rod 42 coupled to the two diaphragms. A fitting 52 is connected to chamber 24, which chamber contracts upon the expansion of chamber 26 and expands upon the contraction of chamber 26. The fertilizer solution is drawn into chamber 24, via inlet 2 and non-return valve 54 upon the expansion of the chamber, and is discharged from the chamber to outlet 4, via non-return and blocking valve 56, upon the contraction of that chamber.

A main valve 60 is provided for controlling the flow of the water from inlet 6 into the expansible chambers 26, 36, and from those chambers to outlet 8. Main valve 60 is controlled by a pilot valve 62, which in turn is controlled by operator elements 64, 66 carried by reciprocating rod 42. Main valve 60 is secured to one of the tie rods 14, and pilot valve 62 is secured to another tie rod, the securement of the latter being effected by a U-shaped bracket 68.

Figure 2:
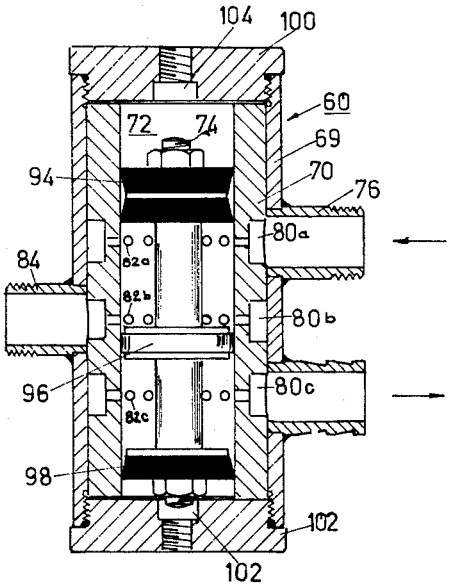
FIG. 2 is a longitudinal sectional view of the main valve in pump of FIG. 1.

The structure of the main valve 60 is more particularly illustrated in FIG. 2. It includes an outer stainless steel tube 69 and an inner bronze body 70 formed with an axial bore 72 in which is disposed a floating piston 74. Inlet water pipe 6 is connected to an inlet 76 (FIG. 6) in the main valve which communicates with one side of bore 72, and outlet pipe 8 is connected to an outlet 78 communicating with the other side of the bore. The bronze body 70 is formed with three annular channels 80*a*, 80*b*, 80*c* spaced axially thereof, and with three sets of radial openings 82*a*, 82*b*, 82*c* passing through the respective channels into bore 72. Channel 80*a* and its openings 82*a* are aligned with inlet 76, and channels 80*c* and its openings 82*c* are aligned with outlet 78. The middle channel 80*b* and its openings 82*b* are aligned with a pipe 84 which is part of a T-fitting 86 (FIGS. 1 and 6) connected on one side via tube 88 to chamber 26, and on the other side via tube 90 to chamber 36.

Floating piston 74 disposed within axial bore 72 includes three piston heads 94, 96 and 98, heads 94 and 98 being of rubber, and head 96 being of plastic. The ends of valve bore 72 are closed by end plugs 100, 102, each formed with a central opening 104, 106.

Figure 3:
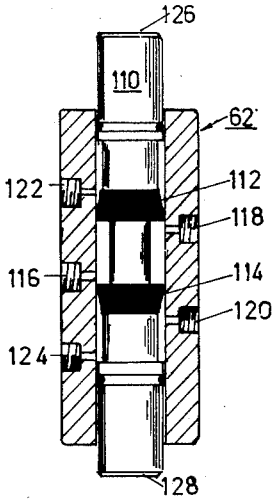
FIG. 3 is a longitudinal sectional view of the pilot valve in the pump of FIG. 1.

Pilot valve 62, shown more particularly in FIG. 3, controls the position of floating piston 74 of the main valve 60. It is also formed with an axial bore 108 having a piston 110 movable therein, the piston carrying two resilient heads 112, 114. Bore 108 is formed with an inlet opening 116 which selectively communicates with one of two outlet openings 118, 120, depending upon the position of the piston head 112. Thus, in the lower position of the piston illustrated in FIG. 3, inlet 116 communicates with the lower outlet 120, whereas in the upper position of the piston, inlet 116 communicates with the upper outlet 118. Bore 108 is further formed with an upper drain hole 122 and a lower drain hole 124. The opposite ends 126, 128 of piston 110 project through the ends of the valve housing so as to be engageable by operator elements 64, 66, respectively, carried by reciprocating rod 42.

Figure 6:
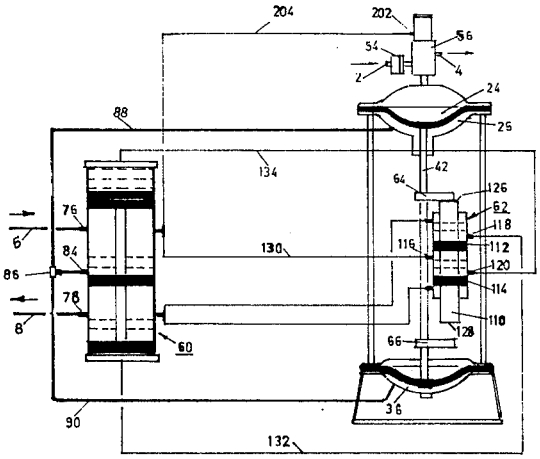
FIG. 6 is a diagram illustrating the hydraulic drive and control system in the pump of FIG. 1.

The inlet 116 into the pilot valve 62 is fed with the driving water from pipe 6 via tube 130 (FIG. 6). The upper outlet 118 leads to the bottom of the main valve via tube 132, and the lower outlet 120 leads to the top of the main valve via tube 134.

The operation of the recprocating pump is as follows: It will be assumed that the cycle starts with the recprocating rod 42 in its down position as shown in FIGS. 1 and 6, which means that both chambers 26, 36 are in their contracted conditions. In this condition, piston 110 of pilot valve 62 is in its lower position, having been lowered by operating element 64 engaging piston end 126. Inlet 116 is thus in communication with the lower outlet 120 of the pilot valve.

The driving water fed through pipe 6 will thus pass via tube 130, inlet 116, lower outlet 120, and tube 134 to the upper end of the main valve 60, thereby lowering the floating piston 74 of the main valve. This will connect the water inlet 76 to pipe 84 of fitting 86 coupled to the expansible chamber 26, 36, whereupon the water from pipe 6 into inlet 76 will expand both chambers 26, 36. This causes the flexible diaphragms 22, 34 to flex upwardly, raising reciprocating rod 42 with them.

The raising of rod 42 causes its lower operating element 66 to engage end 128 of piston 110 in pilot valve 62, thereby raising the piston and establishing communication between inlet 116 and the upper outlet 118.

The water from pipe 6 via inlet 116 will now be fed via tube 132 to the lower end of main valve 60, causing its floating piston to move upwardly, thereby establishing communication between opening 84 and the outlet 78 of the main valve. The water within expansible chambers 26,36 is thus permitted to drain through outlet 78 to outlet pipe 8, as diaphragms 22, 34 are returned to their lower positions by their normal elasticity.

Thus, diaphragms 22, 34 are successively flexed upwardly and downwardly, which causes expansible chamber 24 on the upper side of diaphragm 22 to be successively contracted and expanded. The expansion of chamber 24 draws into its fertilizer solution via inlet 2 and non-return valve 54, and the contraction of that chamber discharges the fertilizer solution through outlet 4 via non-return valve 56.

Figure 4:
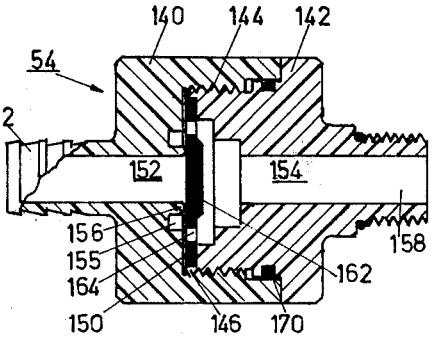
FIG. 4 is a longitudinal sectional view of the fertilizer inlet non-return valve in the pump of FIG. 1.

An improved non-return valve construction used for valve 54 is illustrated in FIG. 4. It includes a housing formed of two sections 140, 142 attachable together by threads 144. Section 142 is formed with an annular rib 146 seated in a circular recess in section 140. In addition, each section is undercut at the surface thereof circumscribed by its respective rib and recess so as to form a cavity when the two sections are fastened together. A flexible diaphragm 150 is held between the rib and recess of the two sections and divides the cavity into an inlet compartment 152 and an outlet compartment 154. Inlet 2 communicates with inlet compartment 152 and includes a circular undercut 155 to define an annular rib 156 bearing against the central portion of diaphragm 150. The opposite face of the diaphragm, spaced from housing section 142, defines the outlet compartment 154 which communicates with outlet 158. An O-ring 160 seals the two housing sections 140, 142 when threaded together.

Diaphragm 150 may be made of chemically-resistant rubber for example. It includes a central thickened portion 162 and a circular array of peripheral openings 164 surrounding same and in alignment with annular recess 155.

In the normal condition of the valve, the central portion 162 of the diaphragm 150 is engaged by annular rib 156. Fluid flow in one direction, from inlet 2 to outlet 158, flexes diaphragm 150 away from annular rib 156, so that the fluid is permitted to flow from inlet compartment 152 through annular recess 155 and openings 164 to the outlet compartment 154 and out through outlet 158. However, fluid flow in the reverse direction (that is, from outlet 158 to inlet 2) is prevented since the fluid flowing in that direction flexes diaphragm 150 tightly against annular rib 156.

The presence of the central thickened portion 162 prevents the diaphragm from being sucked into the inlet compartment 152.

Figure 5:
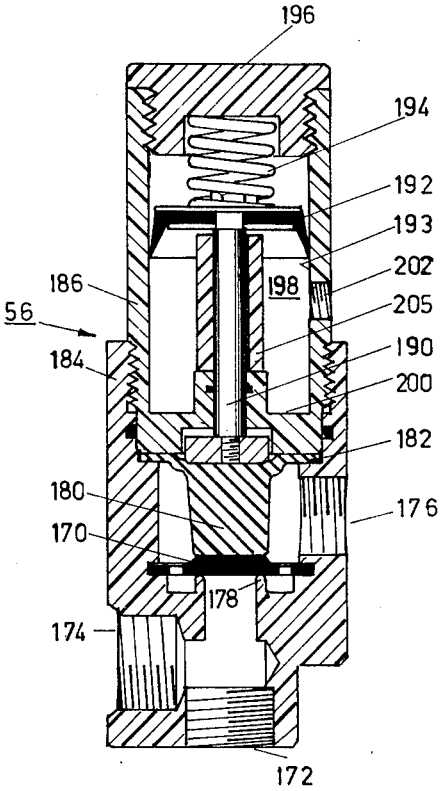
FIG. 5 is a longitudinal sectional view of fertilizer outlet and non-return valve in the pump of FIG. 1.

Non-return end blocking valve 56 is more particularly illustrated in FIG. 5. It includes a similar non-return arrangement as in FIG. 4, comprising a diaphragm 170 (corresponding to diaphragm 150 in FIG. 4) which, operating in the same manner, permits the fertilizer solution to flow from the pumping chamber 24 via inlet 172 and out through outlet 176 to the outlet tube 4, but does not permit the solution to flow in the reverse direction.

The fertilizer solution is supplied to the pumping chamber 24 via inlet 174 connected to outlet 158 of non-return valve 54, and if the supply tank is at a substantially higher elevation than valve 56, the solution head might be sufficient to force diaphragm 170 open and thereby to cause a continuous drain of the fertilizer solution in the event of a loss or drop of pressure in the water supply. To prevent this from ocurring, valve 56 includes a blocking arrangement which presses diaphragm 170 downwardly against the annular rib 178 (corresponding to rib 156 in the valve of FIG. 4) at all times except when there is pressure in the water supply line. This blocking member is in the form of a rubber stem 180 resiliently mounted by an annular resilient margin 182 fastened between the two sections 184, 186 of the valve housing. A disc 188 bears against the central portion of rubber stem 180 to force same against the central portion of the diaphragm 170. A rod 190 is fastened at one end to the disc and carries a piston 192 at the opposite end, the latter piston being spring-urged towards disphragm 170 by means of a spring 194 interposed between the piston and an end cap 196. Piston 192 is movable within a cylinder 197 to define an expansible chamber 198 with an end wall 200 of housing section 186. The latter section is formed with a port 202 leading into chamber 198, port 202 being connectable to a pipe 204 (FIG. 6) supplied with water from the water supply line via tube 130 connected to the inlet supply pipe 6 via the main control valve 60. The downward displacement of rod 190 is limited by sleeve 205 engageable with piston 192 to prevent damage to the diaphragm.

It will thus be seen that if the water supply line is not under pressure, spring 194 urges rubber stem 180 against diaphragm 170, and thereby prevents the flow of fertilizer solution from inlet 174 through outlet 176. However, when the water supply line is under pressure, this pressure is transmitted via pipe 204 (FIG. 6) and port 202 to chamber 198, thereby expanding the chamber and moving piston 192 away from the rubber blocking stem 180 permitting the fertilizer solution to flow through the series of openings in diaphragm 170 to the outlet 176 in the manner described above with reference to the non-return valve 54 illustrated in FIG. 4.

It will thus be seen that a high-capacity reciprocating pump is provided which is driven solely by the pressurized water applied through inlet pipe 6, there being no requirement for electricity either in driving or controlling the pump.

Many other variations, modifications, and applications of the illustrated embodiment will be apparent.

What is claimed is:

1. A fluid-driven reciprocating pump, comprising: a housing defining a pair of expansible chambers each containing a displaceable member movable to expand and contract the respective chamber, the movable member in at least one of the expansible chambers being a flexible diaphragm; conducting means conducting the material to be pumped to the flexible diaphragm chamber so as to be pumped upon the expansion and contraction of the chamber; a reciprocating rod connecting the flexible diaphragm of the one chamber so that they move in unison; a main valve having a driving fluid inlet, a driving fluid outlet, a connection to said pair of expansible chambers, and a piston movable from a first position effecting communication between the fluid inlet and the pair of chambers to introduce the driving fluid into the chambers, to a second position effecting communication between the chambers and the fluid outlet to discharge the fluid from the chambers; a pilot valve having a movable piston and fluid connections to the main valve for controlling the position of the piston of the main valve; and operating means carried by the reciprocating rod engageable with the piston of the pilot valve for controlling the connections between the pilot valve and main valve, and thereby the fluid connections from the main valve to the pair of expansible chambers, to effect an expansion and contraction of the diaphragm chamber; said conducting means comprising an inlet one-way valve and an outlet one-way valve leading to and from the flexible diaphragm chamber; said inlet one-way valve comprising a housing formed with a fluid chamber therein, the chamber having an inlet and an outlet; a flexible diaphragm disposed within said chamber and dividing same into a fluid inlet compartment containing the inlet and a fluid outlet compartment containing the outlet; an annular rib engageable with the center of one face of the diaphragm, the periphery of the diaphragm including a plurality of openings establishing communication between the two compartments, whereby fluid flow from the inlet direction is permitted through said openings by the diaphragm being flexed out of engagement with the annular rib, whereas fluid flow in the reverse direction is prevented by the diaphragm being flexed into engagement with the annular rib.

2. A pump according to claim 1, wherein the displaceable member of the other expansible chamber is also a flexible diaphragm.

3. A pump according to claim 1, wherein the housing includes a plurality of tie rods rigidly coupling the two expansible chambers together.

4. A pump according to claim 1, wherein the operating means carried by the reciprocating rod include a pair of operator elements fixed to the reciprocating rod on opposite sides of the pilot valve piston to engage same during the reciprocation of the rod.

5. A pump according to claim 1, wherein said main valve includes a body formed with an axial bore, and inlet opening communicating with one end of the bore, and outlet opening communicating with the other end of the bore, an annular channel formed exteriorily of the valve body at an intermediate location between the inlet and outlet openings, at least one intermediate opening formed at said intermediate location of the bore and leading therefrom into said annular channel, and a piston axially movable within the bore, the piston including a plurality of piston heads which in one position of the piston establish communication between the intermediate opening and the inlet opening, and in another position establish communication between the intermediate opening and the outlet opening.

6. A pump according to claim 1, wherein the outlet one-way valve includes means effective upon a drop in pressure of the driving fluid for blocking the flow of the material to be pumped through said one-way valve.

7. A pump according to claim 6, wherein said blocking means comprises a piston movable within a cylinder to define an expansible and contractable chamber, a spring biassing the piston in one direction to block the one-way valve in its closed position, and an inlet for introducing the driving fluid into the expansible chamber for moving the piston in the opposite direction to unblock the one-way valve for operation.

8. A pump according to claim 7, wherein the one-way valve includes a normally-closed flexible diaphragm communicating with the pump outlet and opened by the pump outlet pressure, and a pressure member urged by the piston against the diaphragm by said spring, to thereby hold the diaphragm in its closed position upon the loss or drop in pressure of the driving fluid.

9. A pump according to claim 8, wherein the pressure member includes a stem aligned with the center of the diaphragm to press against same, and an annular flexible margin resiliently mounting the stem to release the diaphragm for movement.

* * * * *